US005836625A

United States Patent [19]

Kibble

[11] Patent Number: 5,836,625

[45] Date of Patent: Nov. 17, 1998

[54] BOLT HOUSING, ASSEMBLY, AND FITTED PANEL

[76] Inventor: Anthony Wilfred Kibble, 15 Carnoustie Close, Bloxwich, West Midlands, United Kingdom, WS3 3UH

[21] Appl. No.: 596,354

[22] PCT Filed: Sep. 14, 1994

[86] PCT No.: PCT/GB94/02001

§ 371 Date: Mar. 8, 1996

§ 102(e) Date: Mar. 8, 1996

[87] PCT Pub. No.: WO95/08040

PCT Pub. Date: Mar. 23, 1995

[30] Foreign Application Priority Data

| | | | |
|---|---|---|---|
| Sep. 16, 1993 | [GB] | United Kingdom | 9319207 |
| May 9, 1994 | [GB] | United Kingdom | 9409053 |

[51] Int. Cl.[6] ..... E05C 1/04

[52] U.S. Cl. ..... 292/145; 292/150

[58] Field of Search ..... 292/150, 289, 292/67, 337, 145, DIG. 55, 169.17; 70/32, 34, 52, 53, 23

[56] References Cited

U.S. PATENT DOCUMENTS

| | | | |
|---|---|---|---|
| 47,349 | 4/1865 | Walker | 292/140 |
| 416,486 | 12/1889 | Newton | 292/189 |
| 924,331 | 6/1909 | Feola | 70/32 |
| 955,774 | 4/1910 | Drury | 292/150 |
| 1,001,100 | 8/1911 | Voigt | 292/DIG. 55 |
| 1,224,960 | 1/1917 | Shepherd | 292/189 |
| 1,546,021 | 7/1925 | Parmele | 70/32 |
| 1,579,619 | 4/1926 | Kerby | 292/DIG. 55 |
| 1,722,525 | 7/1929 | Junkunc | 70/52 |
| 1,978,615 | 10/1934 | Wilson | 292/150 |
| 2,769,330 | 11/1956 | O'Connell | 292/169.17 X |
| 2,999,377 | 9/1961 | Raye | 70/32 |
| 3,934,908 | 1/1976 | Rifkin | 292/150 |
| 3,952,565 | 4/1976 | Falk | 70/52 |
| 4,161,333 | 7/1979 | Guttman | 292/150 |
| 4,438,641 | 3/1984 | Levkov | 70/34 |
| 4,802,351 | 2/1989 | Kojak | 70/56 |
| 5,076,621 | 12/1991 | Taylor et al. | 292/183 |
| 5,345,794 | 9/1994 | Jenks | 70/32 |
| 5,438,853 | 8/1995 | Bartsch | 70/DIG. 32 |

FOREIGN PATENT DOCUMENTS

| | | |
|---|---|---|
| 0194500 | 9/1986 | European Pat. Off. . |
| 0348318 | 12/1989 | European Pat. Off. . |
| 1399811 | 4/1965 | France . |
| 2598456 | 11/1987 | France . |
| 13651 | of 1891 | United Kingdom . |
| 179798 | 5/1922 | United Kingdom . |

*Primary Examiner*—Rodney M. Lindsey
*Attorney, Agent, or Firm*—Steven J. Hultquist

[57] ABSTRACT

This invention relates to a bolt housing, and in particular to a housing for a sliding bolt; to a pair of bolt housings, to an assembly thereof for the securement of a first housing relative to a second housing and to panels fitted with one of the said housings. Thus, there is provided a bolt housing which includes a bolt and bolt guide, the bolt having a bolt tip, the bolt being slidably mountable in the guide, the housing having a surface beyond which the bolt tip can project, the guide being at an acute angle to the said surface. There is also provided a bolt assembly comprising a bolt housing as defined herein, the said housing being a first housing, and the said bolt guide being a first bolt guide, the assembly including a second housing, the second housing having second bolt guide, the second bolt guide being alignable with first bolt guide, the bolt being movable into and out of the second bolt guide when the said first and second bolt guide are aligned. There is additionally provided a movable panel fitted with a first housing as defined herein, the panel being one of a sliding panel and a pivoting panel. The housings may be parts of a padlock.

14 Claims, 10 Drawing Sheets

BOLT HOUSING, ASSEMBLY, AND FITTED PANEL

FIELD OF THE INVENTION

This invention relates to a bolt housing, and in particular to a housing for a sliding bolt; to a pair of bolt housings, to an assembly thereof for the securement of a first housing relative to a second housing, and to a panel fitted with one of the said housings.

In this description, directional terms such as "upper", "lower" etc. refer to the embodiments as drawn i.e. "upwards" means "towards the top of the paper as drawn", and other directional terms should be similarly understood. The embodiments are drawn as they would generally (though not exclusively) be oriented in use.

BACKGROUND TO THE INVENTION

It is often necessary to secure a movable panel to a fixed panel, to prevent unauthorised opening movement of the movable panel and so prevent access through the aperture intended to be closed by the movable panel.

Often the movable panel, such as a door, will be mounted in a fixed frame, so that a part of the frame defines the said fixed panel. However, it is also known, as in "double doors", for both panels to be independently movable, and it is therefore often necessary to secure two movable panels together.

The movable panel may be pivotable upon vertical hinges, such as is known for conventional house doors and many windows; it may be a slidable panel such as a patio door slidable in horizontal runners, fixed one above and one below the door; or it may be one of the plurality of sliding laths comprising a vertically-acting roller shutter door such as may be used as a security fitting for a shop-front or vehicle cargo door.

DESCRIPTION OF THE PRIOR ART

Many devices are known for securing the different types of movable panel described. Amongst the most common are those known as "pivotting hook" lock assemblies, and those known as "mortice" lock assemblies.

A pivotting hook lock assembly is usually used with a slidable panel. The assembly comprises a first housing with a bolt in the form of a hook mounted upon a pivot, and engageable behind a keeper e.g. a cross pin mounted in the second housing. The first housing is mounted to or within the movable panel, adjacent one of the panel edges. The path of the hook is part-circular, defined by the pivot and with the axis of the pivot being perpendicular to the direction of movement of the panel; the cross pin is a bar mounted in the second housing parallel to the axis of the hook pivot.

A mortice lock assembly comprises a first housing carrying a bolt, and in use being (usually) fixed to or into the movable panel adjacent one panel edge, and a second housing providing a keeper mounted to a part of the fixed frame surrounding the panel, the keeper having an aperture of a size closely to receive the bolt. The bolt (which may be of round or rectangular section) is substantially rigid and is slidable between a retracted condition and an extended condition (projecting from the first housing), the bolt in its extended condition being inserted within the bolt aperture of the second housing, and being retained in its inserted condition as by locking means located in the first housing, whereby to secure the first housing assembly relative to the (fixed) second housing, thus securing the movable panel.

A known mortice lock assembly has first and second housings which are substantially rectangular in side elevation, and having in the closed and locked condition respective side walls adjacent the facing edges of the panel and frame respectively, so that these housing side walls are substantially parallel. The facing wall of the first housing has a surface through which the bolt tip may project. The path of a mortice bolt between its retracted and inserted conditions is linear, and perpendicular to the facing side walls and to the surface of the first housing. This mortice type of lock is typically used on hinged (pivotable) panels, the said facing edge of the panel being the edge opposed to the hinged edge of the panel.

Hook securement devices are often expensive to manufacture and difficult to fit, and even then may not be as secure as a mortice lock assembly; their resistance against forcing open of the panel is limited by the strength of the hook (curved bolt) and, since any attempt to force the panel away from the frame is transferred directly from the bolt to the pivot, the strength (or weakness) of the pivot is also important. Desirably the pivot is at least as strong as the bolt, but this may be difficult to achieve in practice since the pivot may need to be of reduced size to enable the device to fit within the panel to be secured.

With a mortice-type lock, whilst the bolt can be of significant size, to provide a substantial resistance against both lateral movement (in the vertical direction for a side-hung door), and sideways movement (pivotting upon the hinges) of the panel relative to the frame, the lock cannot resist movement of the panel away from the frame in the direction of movement of the bolt, and it is known for these locks to be "burst" by housebreakers and the like forcing the frame such that the frame becomes locally of increased size relative to the panel, until the inserted bolt can be released from the keeper. Also, if such a lock is used to secure a pair of double doors together, a sufficient force applied to the gap between the doors can also "burst" the inserted bolt from the keeper.

STATEMENT OF THE INVENTION

There is proposed a securement device for a panel or panels which avoids or reduces the disadvantages of the above-described devices.

According to one feature of the invention we propose a bolt housing which includes a bolt and bolt guide means, the bolt having a bolt tip, the bolt being slidably mountable in the guide means, the housing having a surface beyond which the bolt tip can project, the guide means being at an acute angle to the said surface.

Preferably, supplementary holding means are mounted on the housing, the supplementary holding means being at an acute angle to the said guide means, the supplementary holding means being one of a lip member and at least one projecting member.

According to another feature of the invention we propose a housing mounting guide means for a slidable bolt and supplementary holding means, the guide means being at an acute angle relative to the holding means. When assembled to a panel, the bolt will be alignable with second guide means in a second bolt housing, whilst the supplementary holding means will cooperate with holding surfaces of the second housing; preferably the holding surfaces of the second housing are external surfaces so that the supplementary holding means embraces said surfaces, but may be internal surfaces e.g. slots in the second housing walls.

According to another feature of the invention we propose a housing for receiving a slidable bolt, which includes retaining means for the inserted bolt tip. Usefully the retaining means is slidably guided at an acute angle to the bolt longitudinal axis.

There is also proposed a bolt assembly comprising (a) a bolt housing as herein defined, the said bolt housing being a first bolt housing and the said guide means being a first bolt guide means, and (b) a second bolt housing, the second bolt housing having second bolt guide means, the second bolt guide means being alignable with the first bolt guide means, the bolt being movable into and out of the second bolt guide means when the said first and second bolt guide means are aligned. Thus, the assembly has a closed condition in which the said guide means are in alignment, the bolt being slidable between a retracted condition and an inserted condition, the bolt in its inserted condition being received within the second bolt guide means. Usefully, key controlled release means are located in one of the said first and second housings, the bolt having a securement surface engageable with a part of the key controlled release means.

Desirably, supplementary holding means are carried by one of the said first and second housings and are cooperable with the other of the said housings in the closed condition of the assembly, the supplementary holding means when cooperating with the said other of the said housings resisting relative lateral movement of the housings.

Preferably the lock controlled release means is located in the second housing, and includes a spring-biassed plunger having a catch surface engageable with the securement surface of the bolt, the plunger also having an abutment, the abutment being contactable by a part of the lock.

Usefully the supplementary holding means is rigid, and fixed to the first housing. It may be U-shaped and encompass part of the second housing in the closed condition of the assembly, or it may alternatively comprise a U-shaped projection or at least one stud, locatable in one or more corresponding recess(es) in the second housing. Alternatively, the supplementary holding means may be movable, projecting from the first housing only when the bolt is in its inserted condition.

Certain forms of the supplementary holding means will permit a bolt assembly according to the invention to be used for securing either pivotable panels or slidable panels.

Conveniently the bolt carries a handle by which it may be grasped and manually moved to its retracted condition. However, the bolt may be spring biassed towards its retracted condition, and so the handle in the bolt inserted condition may not be needed nor accessible for manual withdrawal.

There is also disclosed a movable panel fitted with one of the said first and second housings.

Usefully, the angle between the bolt guide means and the said surface, or between the bolt guide means and the supplementary holding means, is between 30° and 60°; desirably the angle is between 40° and 50°; preferably the angle is 45°.

BRIEF DESCRIPTION OF THE DRAWINGS

The invention will be further described, by way of example, with reference to the accompanying drawings, in which.

DETAILED DESCRIPTION OF THE PREFERRED EMBODIMENTS

Figure 1:
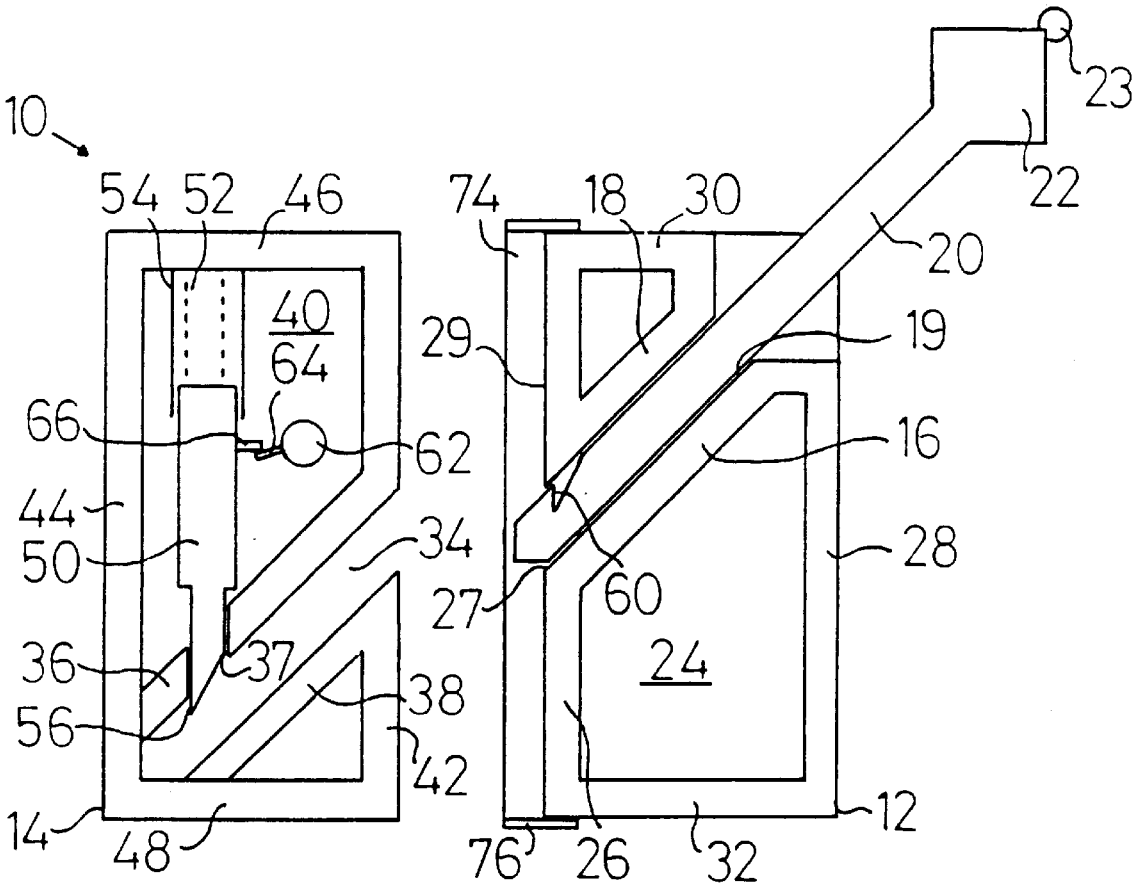
FIG. 1 is a rear view of the first and second housings of a bolt assembly according to the invention, the bolt being in its retracted condition, the arrangement being "left-handed"

The bolt assembly 10 of FIG. 1 comprises a first housing 12 and a second housing 14. First housing 12 is to be fitted to a movable panel, whilst second housing 14 may be secured to a second movable panel or to a fixed frame part for the first panel.

First housing 12 carries guides 16,18, which together with front wall 24 of the first housing define a rearwardly-open bolt carrying channel or first bolt guide means 19, closable by a rear wall (not shown) or by the panel to which the housing is secured in use. A bolt 20 of generally rectangular cross-section is positioned within channel 19, and has at its upper end as viewed a handle 22 by which the bolt may be slidably moved relative to the channel 19. The housing 12 has a surface 29 through which the bolt 20 may project.

As drawn in FIG. 1, the bolt 20 is in its "retracted" condition i.e. it is in its condition allowing the first and second housings to be brought together.

Secured to the front wall 24 are side walls 26,28 and end walls 30,32. In this embodiment, part of the end wall 30 and part of the side wall 28 are removed to allow the handle 22 to be brought into close contact with the first housing 12 as the bolt is moved into its "extended" (and "inserted") condition projecting (to the left as viewed) out of the first housing; if the first and second housings are in the closed condition i.e. they are suitably aligned, the extended and inserted conditions of the bolt will correspond. In this embodiment the handle is shaped so that in the bolt extended or inserted condition no part of the handle 22 stands proud of the housing front wall 24; an outwardly projecting finger grip 23 is provided to assist with bolt withdrawal movement, though this is not essential.

It will be understood that different forms of handle 22 may be provided, or front wall 24 can be cut away to provide easier access to handle 22 when the bolt is in the inserted condition. Furthermore, a return spring may be provided to effect partial movement of the bolt 20 from its inserted condition towards its retracted condition such that the handle 22 may only be grasped after the bolt has been partially moved by the spring.

Side wall 26 is apertured at a position 27 aligned with the lower insertion end of bolt 20. Guides 16,18 defining bolt carrying channel 19 are at an acute angle to side wall 26, and to surface 29.

The second housing 14 has a rearwardly-open bolt receiving channel or second bolt guide means 34 defined by guides 36,38, and front housing wall 40. The housing can be closed by a rear cover (not shown), or by the panel to which the second housing in use is secured, whereby also to provide a fourth side to channel 34 and thus to guides 36,38 defining the channel 34.

Secured to the front wall 40 of the second housing 14 are side walls 42,44 and end walls 46,48. Also secured to front wall 40 is a lock having a key-operated rotatable lock barrel 62, and a chamber 54. The chamber 54 locates part of a plunger 50 and a spring 52, the spring 52 biassing the plunger 50 away from end wall 46. The plunger 50 and spring 52 comprise a part of the bolt release means. Plunger 50 is at an acute angle to channel 34, and thus to the longitudinal axis of bolt 20 when inserted i.e. in this embodiment plunger 50 is disposed substantially parallel to side wall 26 of the first housing, typically both being vertical in the position of use.

Specifically, in use, the first and second housings are mounted on panels so that when the panels are brought together to their "closed" condition, the bolt carrying channel 19 and the bolt receiving channel 34 are in alignment, whereupon bolt 20 may be inserted into the bolt receiving channel 34.

Plunger 50 is guided and supported at one of its opposed ends in chamber 54, whilst its other opposed end is guided and supported in an aperture 37 in guide 36; catch surface 56 of plunger 50 projects into the bolt receiving channel 34. Abutment 66 of plunger 50 engages finger 64 of the lock to define the axial position of the plunger 50.

Preferably the leading end of the bolt 20 is chamfered so that during insertion movement into second housing 14 the plunger 50 is pushed upwardly against the action of the spring 52; with further insertion movement ledge 60 of bolt 20 aligns with the catch surface 56, which is urged by spring 52 behind ledge 60 so that the assembly is thus urged into the "locked" condition, requiring operation of the lock-controlled release means as described below to effect retraction of the bolt 20.

Figure 4:
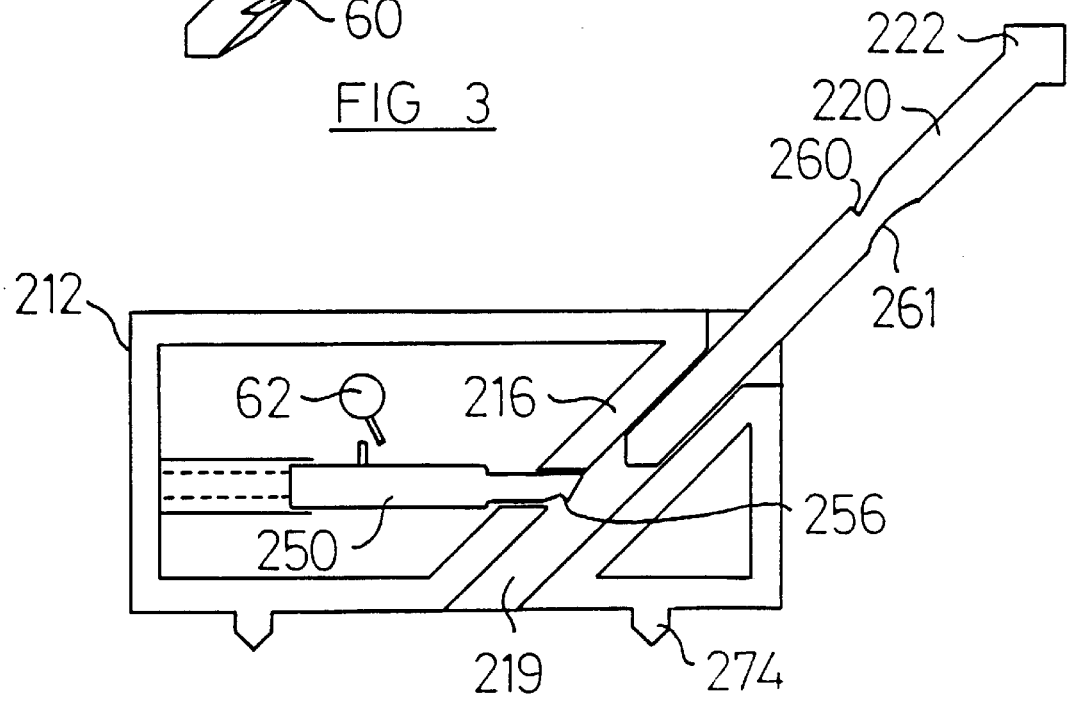
FIG. 4 is a rear view of a third embodiment of first housing.

In an alternative embodiment with provision for "temporary" securement, as may be required if a panel is to be held closed without needing to be locked, a spring-biassed ball of known type is mounted in guide 36 to project into channel 34 and is engageable with ledge 60, the detent providing a "partially inserted" holding condition of bolt 20. In this partially inserted condition, the housings are held together, but their securement may be released simply by grasping the handle 22 and retracting the bolt i.e. the key is not required to effect retraction of the bolt. However, when the assembly is required to be locked, the bolt can be pushed past the ball until the catch surface 56 engages the ledge 60. An alternative means for temporary securement is shown in FIG. 4, as described below.

In a further alternative embodiment, catch surface 56 does not normally project into bolt receiving channel 34. However, when bolt 20 has been fully inserted into second housing 14, the lock barrel 62 can be key-operated to turn finger 64 anti-clockwise as viewed, to permit spring 52 to bias catch surface 56 of plunger 50 behind ledge 60. In another alternative embodiment, and for use when the assembly can be mounted with the plunger 50 vertical, and suitably greased or lubricated, spring 52 is omitted, the plunger 50 dropping into the securement condition under its own weight. In both these alternative embodiments, key operation is also required to turn lock barrel 62 clockwise, to lift finger 66 and thus plunger 50, to release bolt 20 ready for withdrawal from second housing 14.

In yet another embodiment the bolt 20 is circular in cross section, with an annular groove providing the locking ledge; this embodiment may be preferred for heavy use situations, to limit possible impact damage to and/or excessive wear of the ledge.

When fitted to respective panels there will be a gap between first and second housings 12,14, which will normally be larger than the gap 75 between adjacent closed panels 70,72 (FIG. 9) to which the housings are fitted. To cover this housings gap, one housing mounts a U-shaped lip 74, carried upon front wall 24 and end walls 30,32. In this embodiment the lip 74 is on first housing 12, which in use is closed against second housing 14. One advantage provided by lip 74 is that in the locked condition of the assembly the lip 74 obscures that part of the bolt 20 which would otherwise be visible through the housings gap and which could therefore be attacked i.e. the lip 74 can inhibit unauthorised access as with a hacksaw to that part of the bolt.

As a further feature of the invention the lip 74 also acts as a supplementary holding means, inhibiting relative lateral (in the plane of the paper, towards or away from the top of the sheet as drawn) movement between the first and second housings.

Figure 2:
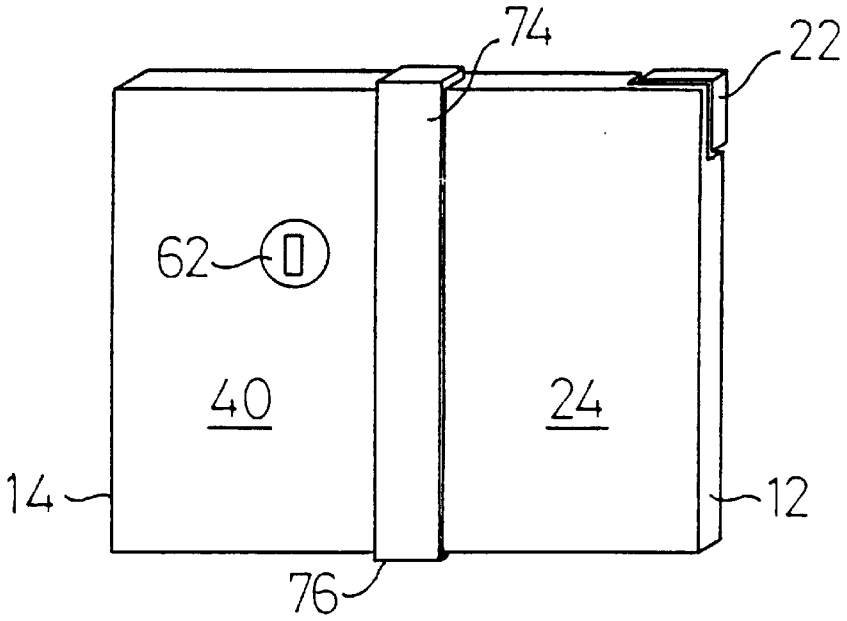
FIG. 2 is a front, perspective, view of bolt assembly similar to FIG. 1 in the closed and locked condition, the arrangement being "right-handed"

If bolt 20 cannot be cut or severed, an alternative means for attempted unauthorised opening of one or both panels could be to position a tool in gap 75 whereby to lever one panel against the other until the door "bursts", with movement parallel to (and then possibly out) of the paper as viewed for FIG. 2, until the bolt escapes from the second housing. However, because the bolt 20 enters the second housing at an acute angle to the adjacent side walls 26,42 of the first and second housings respectively, any attempt to force the locked housings apart will furthermore tend to force the first housing upwardly relative to the second housing, with the housings "riding" upon bolt 20, which action will be resisted by the supplementary holding means provided by the portion 76 of lip 74. Thus, the acutely-angled bolt 20 and the portion 76 of lip 74 provide a wedging action resisting forcing open or bursting of the locked assembly.

For a side-hinged panel which is mounted in a fixed frame, for example a pivotally-mounted door, it might be possible to mount one of the prior art mortice lock assemblies so that the path of the bolt into and out of a frame-mounted keeper is at an acute angle to the facing edges of the panel (when in the closed condition) and frame. In such a case, an attempt to burst the bolt from its keeper by forcing those facing edges apart could result in relative lateral movement between the panel and the frame. The panel may, however, be constrained against such lateral movement by the overlying top edge of the frame (above it) or by the floor or ground (below it), depending upon the orientation of the bolt. However, such constraint against lateral movement will only become effective when the lateral movement exceeds the gap between the top of the panel and the corresponding frame part, or the bottom of the panel and the floor, and the gap may allow sufficient lateral movement for the angled bolt to be burst from the keeper. In the embodiments shown, the cooperative relationship between the supplementary holding means and the sliding bolt can be pre-determined and controlled; the degree of relative lateral movement permitted between the fitted housings, and thus between the panel and frame to which they are fitted, is determined by the inbuilt sliding clearance between the bolt and the bolt-carrying and bolt-receiving channels and/or between the supplementary holding means and the surface(s) with which it engages or they engage.

Figure 3:
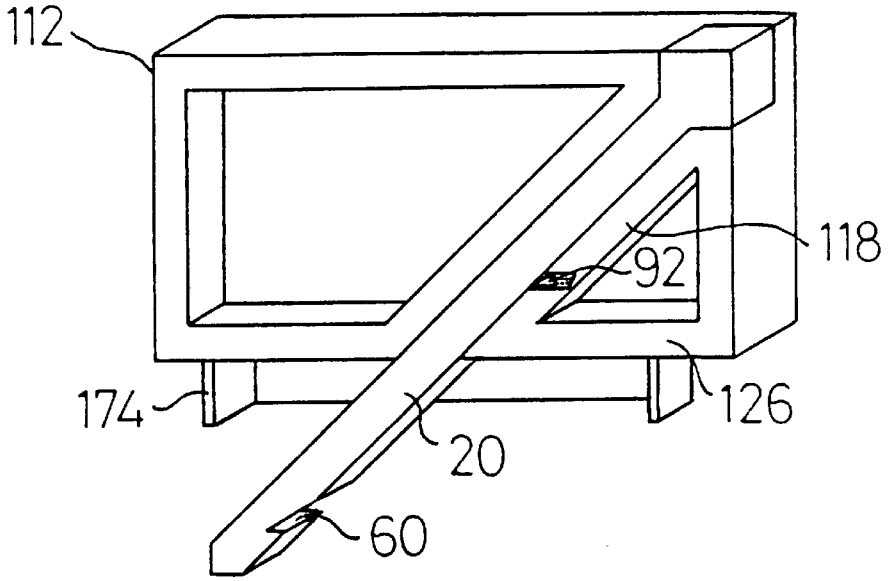
FIG. 3 is a rear view of a second embodiment of first housing, with the bolt in its extended condition.

In the embodiment of FIG. 3, only the first housing 112 is shown, though the form of the second housing will be understood by reference to FIG. 1. The first housing 112 is shown rotated through 90° relative to the housing 12 of FIG. 1, i.e. it is shown in its position of use if fitted for example to the lowest lath of a vertically acting roller shutter, typically for a cargo vehicle or shop-front.

First housing 112 has secured to its side wall 126 a U-shaped shaped projection 174 which cooperates with a corresponding recess in the side wall of the second housing to prevent relative lateral (leftwards and rightwards in this embodiment) movement of the engaged housings. Thus in this embodiment the projection 174 provides the supplementary holding means. Also shown in FIG. 3 is a second catch 92, which is mounted in guide 118 and is spring biassed towards the bolt carrying channel. The second catch 92 will engage the ledge 60 when the bolt 20 is in its retracted condition, preventing removal of the bolt from the first housing.

In the embodiment of FIG. 4, the supplementary holding means is provided by a pair of studs 274 projecting from side wall 226. As the first housing 212 is brought towards the second housing (not shown), the studs enter correspondingly shaped holes in the second housing, so preventing the relative lateral movement between the housings.

FIG. 4 shows the key-controlled release means mounted in the first housing 212. One end of the plunger 250 is passed through guide 216 and the catch surface 256 projects into the bolt-carrying channel 219. The bolt 220 has a securement surface 260 which is engageable with the catch surface 256 in the extended and inserted conditions of the bolt. The catch surface 256 may be moved out of contact with the securement surface by rotation of the lock barrel 62 as described in relation to FIG. 1.

Such an embodiment with the key controlled release means mounted in the first housing is desirable for applications such as the roller shutter door for a shop-front or the like, where the second housing is fixed into the ground, or in other circumstances where the second housing is inaccessible. However, where both the first and second housings are accessible, it is preferred that the key controlled release means be mounted in the second housing.

It will be understood in this figure that in the locked condition, the handle 222 is not in tight mating engagement with the first housing 212, but permits sufficient movement of the bolt 220 (to the bottom left of the paper as drawn), to allow the securement surface 260 to become free of the (downwardly angled) catch surface 256. However, in an alternative embodiment the path of movement of the plunger is perpendicular to the path of movement of the bolt, so that in the locked condition the handle may be in tight mating engagement with the first housing.

FIG. 4 also shows a means of temporary securement of the assembly in the closed, but not locked, condition. The bolt 220, which is of rectangular section, has a shallow indentation 261 in its face opposed to the securement surface 260. The bolt 220 is removable from the channel 219, so that it may be rotated through 180° about its longitudinal axis, and reintroduced into the channel 219, so that in its extended and inserted conditions the catch surface 256 engages the indentation 261.

The indentation 261 has smoothly sloping sides, to allow the catch surface 256 to ride thereover. The shape and depth of the indentation 261 is determined to permit the plunger 250 to remain in engagement with the indentation, and so retain the bolt, against vibration-induced axial movement, but yet to permit manual retraction of the bolt when desired; thus if a sufficient axial force is applied to the bolt 220, the plunger rides up and out of the indentation 261, allowing retraction of the bolt. Thus, with the bolt 220 in this orientation, the assembly may be closed and temporarily secured, without need of the key to release the bolt.

When it is desired that the assembly be locked, the bolt 220 may be removed from channel 219, and reintroduced in the orientation as drawn.

In an alternative embodiment, the bolt is of circular cross-section, so that it does not need to be removed from the channel to effect the necessary axial rotation; in this embodiment, the acircular handle ensures that the bolt must be in one of its two desired orientations relative to the housing when in the extended or inserted condition. Furthermore, the handle ensures that axial rotation of the bolt cannot be effected when the bolt is in its extended or inserted condition.

The handle 222 could carry an indication of its orientation e.g. "UNLOCKED" and "LOCKED" printed or stamped on opposite faces, one or other of the faces being visible to the user, so that in the inserted condition of the bolt, the user can tell if the assembly is locked or only temporarily secured. Alternatively, the handle could be offset from the longitudinal axis of the bolt, so that in the temporary securement orientation, the handle protrudes from the housing in the inserted condition.

Figure 5:
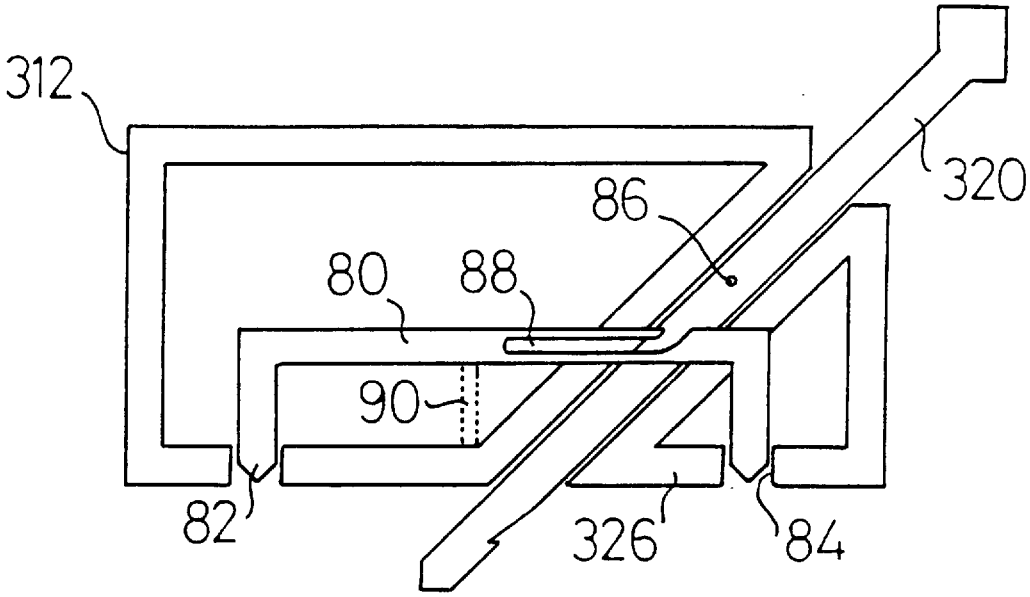
FIG. 5 is a rear view of a fourth embodiment of first housing.

In the embodiment of FIG. 5, the first housing 312 carries a frame 80 of inverted U-shape. The frame has two arms 82 which can pass through apertures 84 in side wall 326. The bolt 320 carries a peg 86 which is engageable in slot 88 of the frame. As the bolt 320 is moved towards its inserted condition, the peg 86 enters the slot 88, and moves the frame downwardly as viewed, causing the arms 82 to project from the first housing 312, and into corresponding recesses in the second housing (not shown).

The slot 88 also ensures that the arms 82 are withdrawn into the first housing as the bolt is moved from its inserted condition. Additionally, however, frame 80 is biassed inwardly of the first housing by a spring 90, which also acts to partially move the bolt 320 away from its inserted condition. It will be understood that instead of the peg 86 entering a slot in the frame, it may instead engage the frame upper (as viewed in FIG. 5) surface.

In alternative embodiments, the peg is retained in a closed slot (i.e. not open-ended as is slot 88); whether the peg is retained in an open-ended slot or not depends on the amount of movement required by the arms in relation to the movement of the bolt, and so can be determined by the user.

Figure 6:
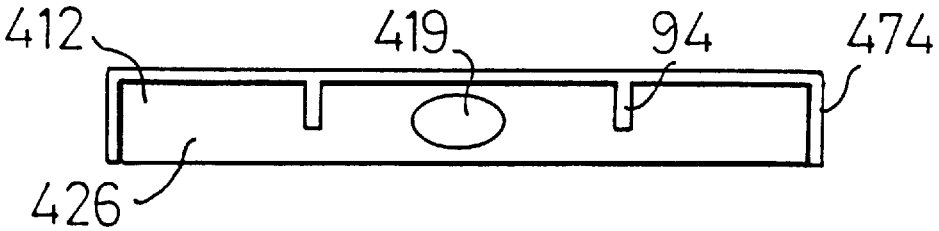
FIG. 6 is a bottom view of a fifth embodiment of first housing.
Figure 7:
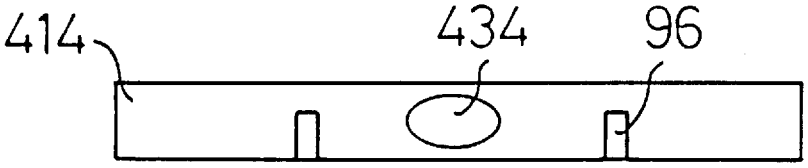
FIG. 7 is a top view of a second housing used with the first housing of FIG. 6.

The embodiments of housings shown in FIGS. 6, 7 are similar to those of FIG. 1, except that the bolt (not shown) is circular, and is slidable in a circular bolt carrying channel 419, and bolt receiving channel 434; also, the lip 474 providing the supplementary holding means includes two additional extensions 94 projecting (out of the paper as viewed) from side wall 426, the extensions being locatable in recesses 96 in the side wall 442 of the second housing 414. The supplementary holding means 474 of this embodiment provides additional security over that of FIG. 1, since in, the locked condition of the assembly the extensions 94 are inaccessible, whereas a determined thief may have the tools necessary to remove (as by grinding off) the exposed portion of lip 474.

Figure 8:
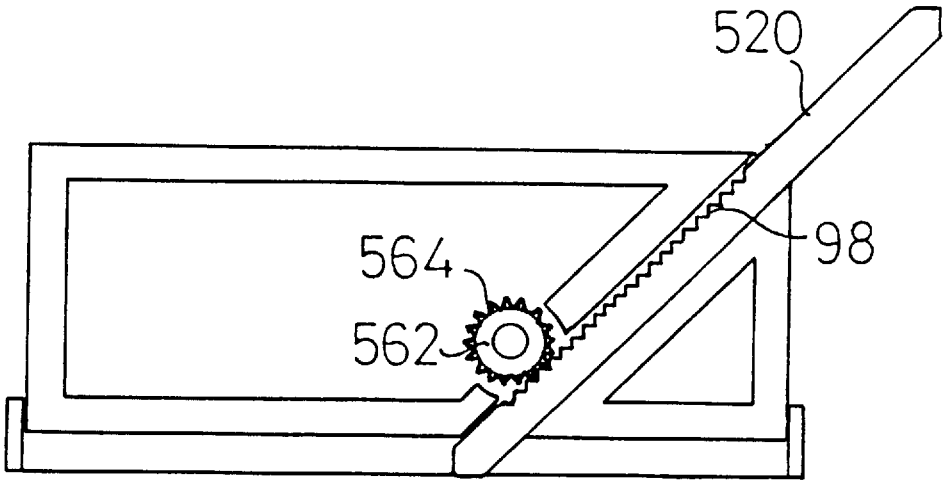
FIG. 8 is a rear view of a sixth embodiment of first housing.

In the embodiment of FIG. 8, the lock barrel 562 has a plurality of teeth 564 engageable with a rack 98 in the bolt 520. Rotation of the barrel 562 following the insertion of the correct key (not shown) will cause the bolt 520 to be moved between its retracted condition and inserted condition. In this embodiment, the bolt 520 is of rectangular section, though in other embodiments it is circular, with the "rack" being provided by a series of annular grooves, or else by a single helically-cut groove. If the groove is helically-cut, it can also be arranged that the bolt rotates about its longitudinal axis as it moves between its retracted and inserted conditions, the bolt mating with a fixed and corresponding helical thread in the second housing.

Figure 9:
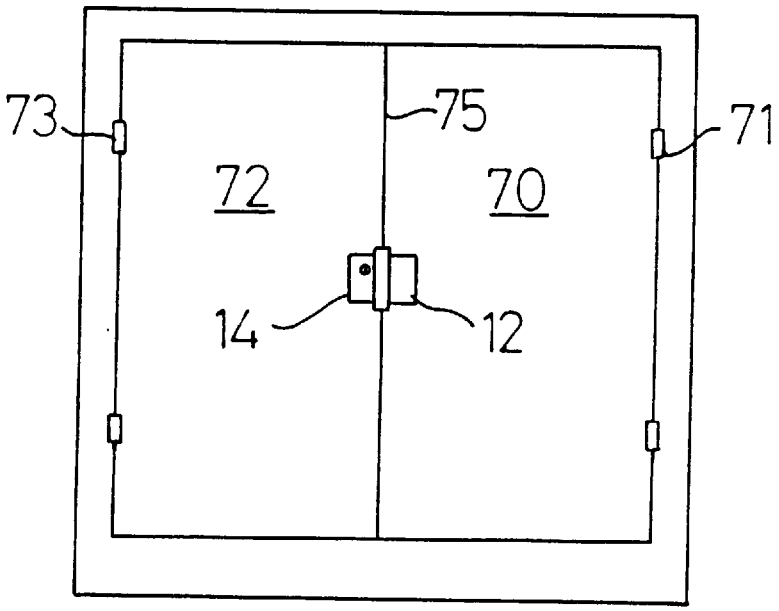
FIG. 9 is a view of a set of double doors, with the first and second housings of a bolt assembly fitted to the respective doors.

As seen in FIG. 9, in use the first housing 12 is secured to a movable panel, which in this embodiment is one door 70 of a pair of double doors. Door 70 is side-pivotted on hinges 71. The second housing 14 is secured to a separate movable panel, which in this embodiment is door 72, side-pivotted on hinges 73. In another embodiment, the second housing is secured to the fixed vertical frame part of a door frame. In yet another alternative embodiment, the movable panel is vertically acting, such as the roller shutter door of a shop-front, the first housing being secured to the lowermost (in use) lath of the shutter, the second housing being secured in the ground.

Whilst the supplementary holding means 174,274 of the FIG. 3 and FIG. 4 embodiments respectively are rigid and project from the first housing and into a part of the second housing in use, if they are fitted to pivotable panels such as those of FIG. 9, they may foul the second housing as the panels are pivotted together i.e. as the assembly is closed; thus these embodiments are most suitable for the securement of slidable panels. However, the embodiment of FIGS. 1 and 2, and the embodiment of FIG. 8, wherein the supplementary holding means is external to the housings in the closed condition, and the embodiment of FIG. 5, wherein the supplementary holding means engages the second housing only in the extended condition of the bolt, would be suitable for both slidable and pivotable panels. Also, whilst the embodiment of FIGS. 6, 7 has a fixed supplementary holding means engageable with recesses in the second housing, the recesses are open towards the opening direction of the assembly; thus, this embodiment could also be used for both slidable and pivotable panels.

Figure 10:
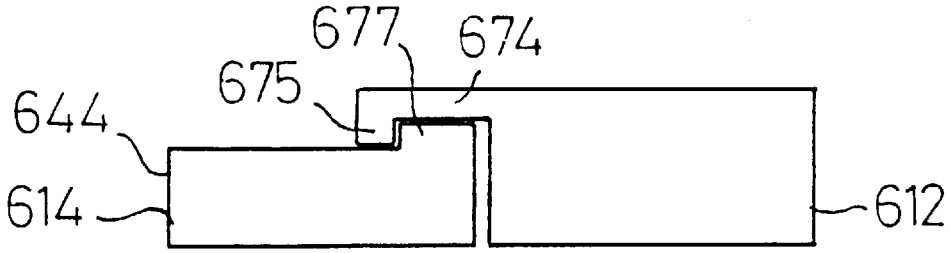
FIG. 10 is an end view of a seventh embodiment of first and second housings.

In the embodiment of FIG. 10, the lip 674 of the first housing 612 has a flange 675, which cooperates with an upstand 677 of the second housing 614. The flange and lip provide an additional resistance to bursting apart of the housings, and thus of the panels to which they may be secured, i.e. an attempt to force apart the first and second housings is inhibited i.e. to the right and left as viewed in FIG. 10 respectively, whether or not the bolt is in its inserted condition securing the two housings together. In another embodiment, the lip 674 may be extended to the left as viewed, and a flange may be provided to fully encompass the second housing 614 i.e. the flange may cover the side wall 644. Clearly, these embodiments are not suitable for use on slidable panels.

Figure 11:
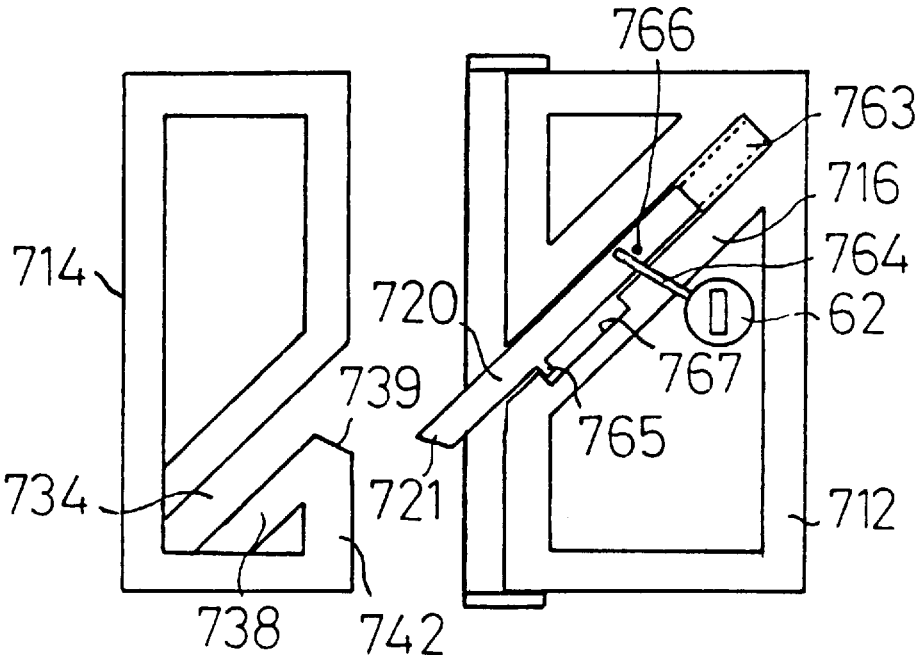
FIG. 11 is a rear view of an eighth embodiment of first and second housings.

In the embodiment of FIG. 11, for use on a slidable panel or panels, the bolt 720 is biassed towards its extended condition by a spring 763. The travel of the bolt 720 is limited by a pin 765 located in a slot 767 in the guide 716. The bolt 720 has a lead-in 721, and the second housing 714 has a lead-in 739 formed in the guide 738 and side wall 742.

When the bolt 720 is in its fully extended condition (as shown), the first housing 712 and second housing 714 may be slid together (in the plane of the paper of FIG. 11), causing the bolt 720 to ride up the lead-in 739, compressing the spring 763. As the bolt lead-in 721 clears the second housing lead-in 739, the spring 763 causes the bolt to enter the bolt-receiving channel 734, whereupon the housings are secured against separation, as previously explained.

When it is desired to separate the first and second housings, the lock barrel 62 is rotated clockwise (in this embodiment by its key), causing the finger 764 first to engage bolt abutment 766 and then to urge the bolt out of the bolt-receiving channel 734 against the action of the spring 763. Thus, this embodiment automatically acts when the housings are brought together, and requires operation of the key controlled means to allow subsequent separation of the housings.

Figure 12:
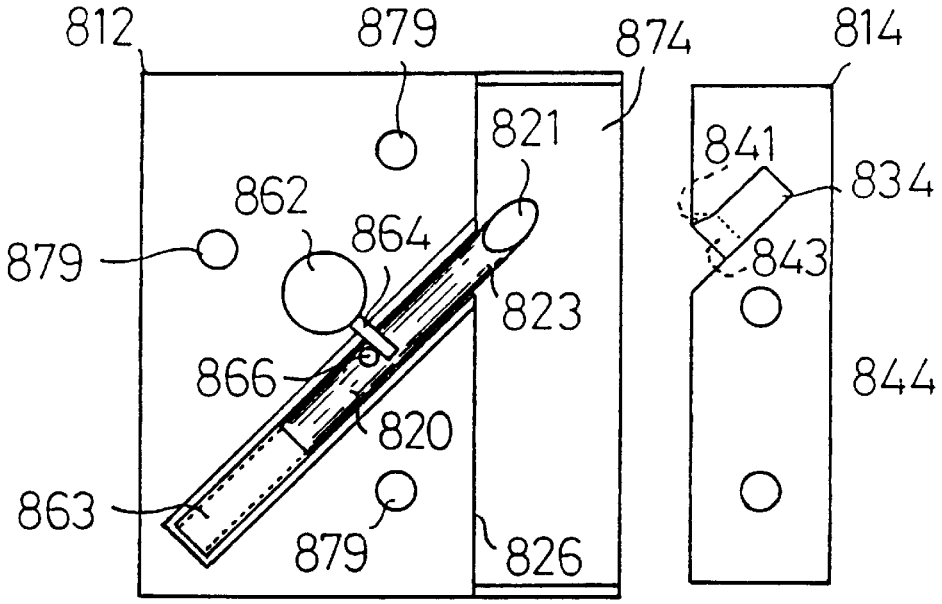
FIG. 12 is a rear view of a ninth embodiment of first and second housings, with the back cover(s) or wall(s) removed.
Figure 13:
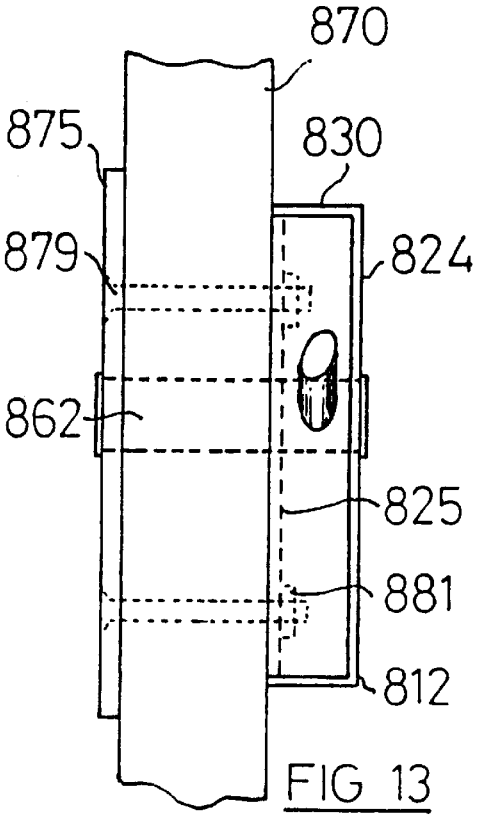
FIG. 13 is a side view of the first housing of FIG. 12, fitted to a panel.
Figure 14:
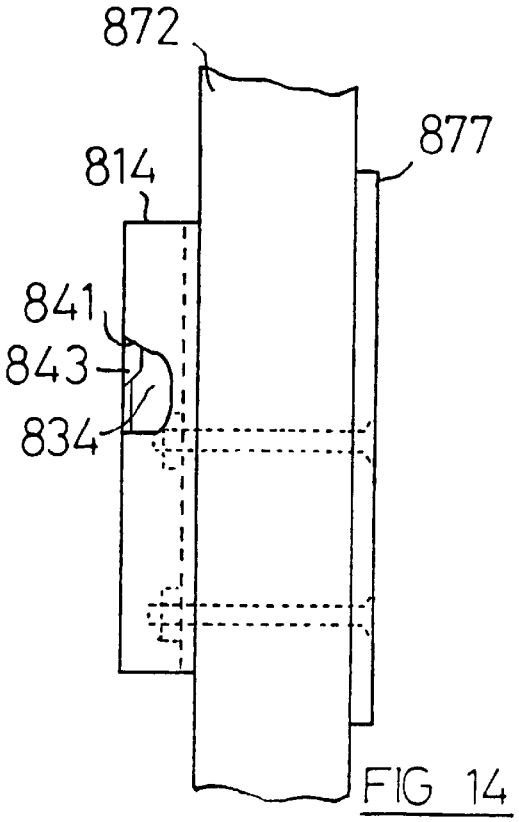
FIG. 14 is a side view of the second housing of FIG. 12, fitted to a panel.

In the embodiment of FIGS. 12–14 adapted for use with a pivotable panel 870, such as the front door of a domestic dwelling, the bolt 820 is similarly biassed towards its extended condition by a spring 863. In this embodiment, the bolt 820 has a partially extended condition, and a fully extended condition. As drawn, the bolt is in the partially extended condition, into which it is biassed by the spring 863. It will be understood that the embodiment shown is adapted for use on a vertical panel, and will be fitted with the bolt projecting from the first housing 812 in an upward direction. Thus, the spring 863 is opposed by gravity acting upon the bolt 820. The length and strength of the spring 863 is chosen to permit the bolt 820 to adopt a rest condition with the bolt tip 823 partially extending from the side wall 826. In this condition, the housings may be brought together, so that the bolt lead-in 821 rides over the lead-ins 841,843 on the second housing 814, compressing the spring 863, until the bolt tip 823 enters the bolt receiving channel 834.

In this embodiment, the lip 874 is of a size fully to cover the second housing 814 when the first and second housings are brought together, for added security and improved aesthetic appeal, though in other embodiments the lip 874 may be smaller. In yet other embodiments, the lip 874 may have a flange as in the FIG. 10 embodiment; the flange may cover the side wall 844 of the second housing.

Thus, the bolt of first housing 812 has a partially extended and inserted condition, which with the respective second housing provides the security of the above mentioned assemblies. However, the bolt 820 also has a fully inserted condition providing a further degree of security. Thus, full rotation of the lock barrel 862 in an anti-clockwise direction as viewed will cause the finger 864 to engage the left-hand side (as drawn) of the abutment 866 and then further extend the bolt 820 from the first housing 812, and so further insert the bolt 820 into the bolt-receiving channel 834 of the second housing 814. Rotation of the lock barrel 862 in the opposite (clockwise) direction will release the bolt 820 from the bolt-receiving channel as previously explained.

In this embodiment, the bolt 820 becomes free of the spring 863 when the bolt is in the fully extended condition. In an alternative embodiment, the spring can be connected to both the first housing and the bolt so that it acts in both the compression and extension directions to bias the bolt towards its rest (partially extended) condition; in such an embodiment, gravity is not required to combine with the spring to move the bolt to the rest condition, so that the bolt can alternatively be downwardly projecting.

In certain embodiments the first and second housings are secured to respective panels 870,872 by screws in known fashion; in some embodiments, the screws are captive to the respective housing. Alternatively, as shown in FIGS. 13 and 14, they are secured by way of respective mounting plates 875,877.

Mounting plate 875 carries three mounting bolts 879 (only two of which are shown in FIG. 13, in dotted outline, for clarity), and each of which is threaded. The mounting plate 875 is located on the "outside" face of the panel, e.g. a door, with the mounting bolts 879 passing through holes pre-drilled through the panel.

The first housing 812 has a rear wall 825 with apertures to receive the mounting bolts 879; nuts 881 are screwed onto the mounting bolts to secure the housing to the panel. In this embodiment, a double-ended lock barrel 862, e.g. of Euro-profile, is located in an aperture in the panel, such that a key may be inserted into the barrel from either end i.e. from either side of the panel.

To obscure the nuts 881 and mounting bolts 879 from view, the front wall 824, end walls 830,832, and connected side wall (not seen), are of unitary construction, and are separable from the housing 812, being secured thereto only after the nuts 881 have been fully tightened upon the respective mounting bolts 879. In an alternative embodiment, the front wall is apertured to allow access to the bolts 879, which access may be concealed and/or closed off by a plate fitted into the first housing.

The second housing 814 is fitted to panel 872 in similar fashion (FIG. 14).

Figure 15:
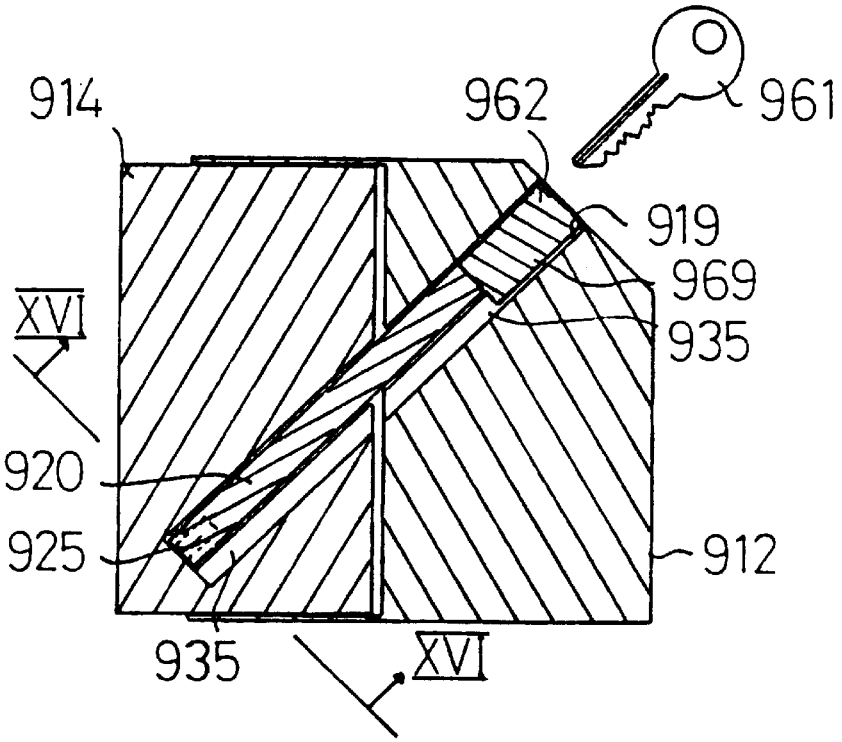
FIG. 15 is a rear sectional view of an assembly of a tenth embodiment of first and second housings and a removable bolt.
Figure 16:
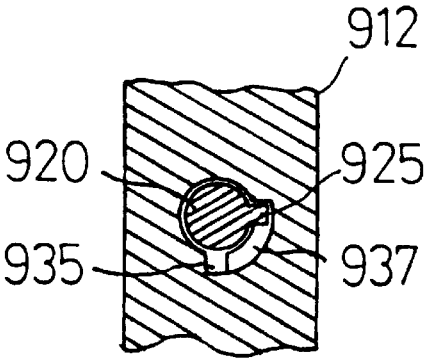
FIG. 16 is a partial sectional view along the line XVI—XVI of FIG. 15.
Figure 17:
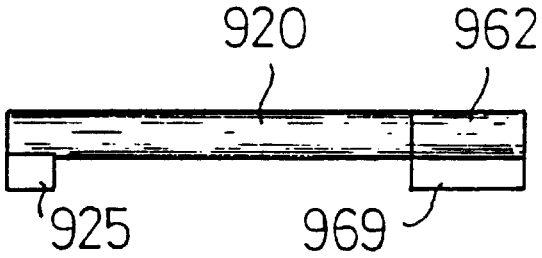
FIG. 17 is a side view of the removable bolt of the assembly of FIG. 15.

In the embodiment of FIGS. 15–17, the housings are of substantially solid construction. The lock barrel 962 is secured to the end of the bolt 920, and the bolt and lock barrel are removable from the first housing 912. The bolt 920 is rotatable relative to the lock barrel 962, which lock barrel is slidably, but non-rotatably, located in the bolt-carrying channel 919 of the first housing 912.

When it is desired to secure the housings together, the housings are first brought into the "closed" condition, with the bolt-carrying channel 919 of the first housing in alignment with the bolt-receiving channel 934 of the second housing. The bolt 920 and lock barrel 962 are then introduced into the channels 919,934.

The bolt carries an outwardly projecting abutment 925, which can pass along a groove 935, which provides an extension of the channels 919,934. The lock barrel 962 has a projection 969, which also fits into groove 935, which projection and groove prevent the rotation of the lock barrel 962 in the bolt-carrying channel 919.

Part of the bolt-receiving channel 934 is undercut to provide a step 937 (FIG. 16), behind which the projection 925 can locate. Thus, when the bolt is fully inserted into the bolt receiving channel 934, the key 961 may be rotated in the lock barrel 962, rotating the bolt 920 so as to locate the projection 925 behind the step 937. The projection 925 and step 937 will thus prevent removal of the bolt 920, and so prevent the separation of the housings 912,914.

This embodiment may be useful for example for securing the rear cargo doors of a delivery vehicle, which vehicles may have several different drivers. A particular problem which this embodiment seeks to overcome is the traditional use of a single key shared between a number of authorised deliverymen. Regrettably it is known for one dishonest driver to arrange for a copy of the key to the rear doors be made, which copy-key may then be used to unlock the doors to facilitate theft of the vehicle's cargo, at a time when the dishonest driver is absent elsewhere. When the theft occurs, the owners find it difficult to know which driver of several is responsible.

However, with this embodiment of the invention, each driver can be given a personal lock barrel and bolt, with that driver using his personalised bolt only when he is responsible for or driving the vehicle. Whilst the dishonest driver can obtain a copy of his own key, if he does so and facilitates its dishonest use his responsibility for any cargo theft is easier to determine.

In the embodiment of FIGS. 18–22, the first and second housings form parts of a padlock, and thus are designed so as not to require securement to respective panels.

Figure 18:
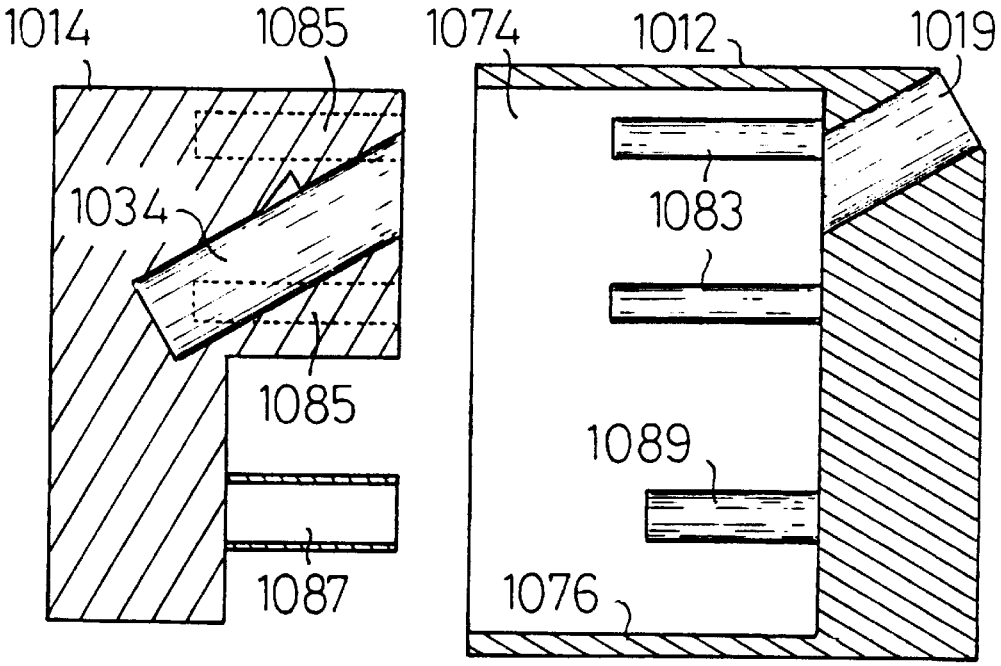
FIG. 18 is a rear sectional view of an eleventh embodiment of first and second housings.

In the embodiment of FIG. 18, the first housing 1012 includes an extended lip 1074 and portions of the supplementary holding means 1076, to encompass the second housing 1014 when the housings are brought together. The first housing also has studs 1083, which are circular in cross-section and are fittable into holes 1085 in the second housing. The studs 1083 and their respective holes 1085 provide additional supplementary holding means (resisting lateral relative movement of the housings), and also provide guidance when bringing the housings together. In this embodiment there are four studs, only two of which are seen in the drawing, and the respective stud holes surround the bolt-receiving channel 1034.

Secured to the second housing 1014 is a tube 1087 which surrounds a stud 1089 carried by the first housing 1012.

When the housings are brought together (FIG. 19), the studs 1083 fit into their respective holes 1085 and the stud 1089 fits into the tube 1087. The tube 1087 and stud 1089 provide the shackle of the padlock, which may for example pass through a staple fitted to a hasp or other member to be secured, in known fashion. In another embodiment, the shackle is a solid rod, secured to either of the first or second housings, and fittable into a hole in the other of the said housings. In yet another embodiment, the shackle is not of circular cross-section.

Figure 19:
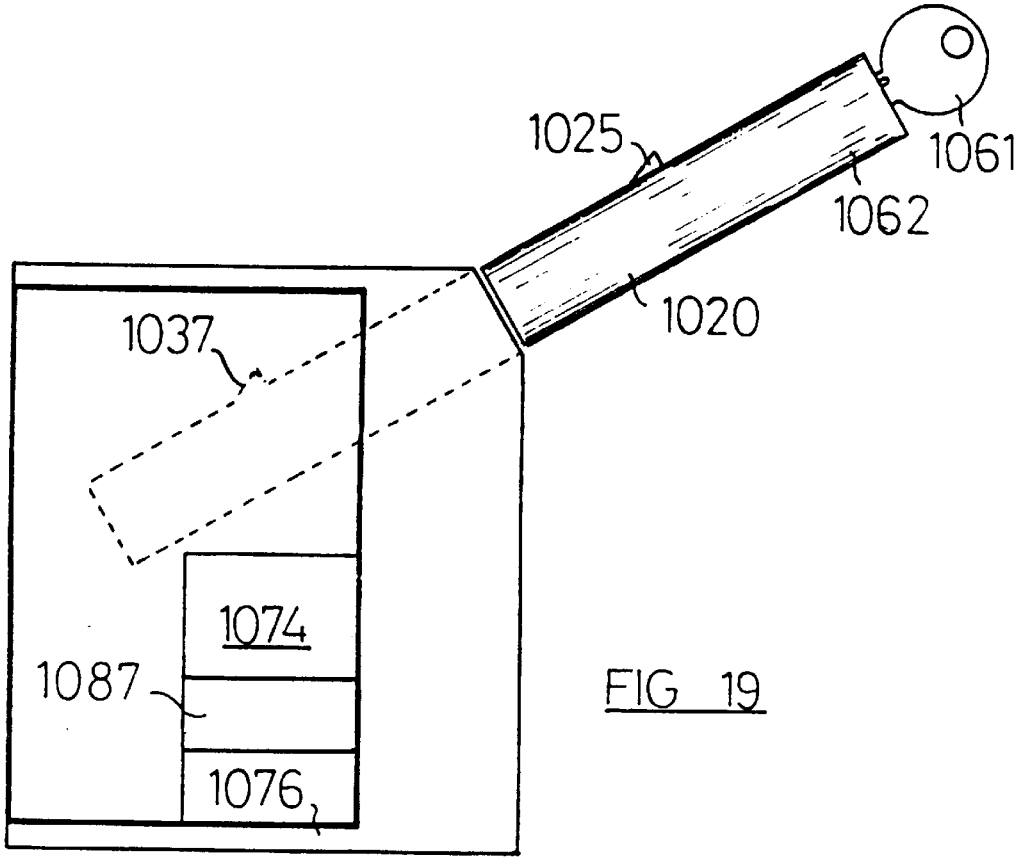
FIG. 19 is a rear view of the assembly of the first and second housings of FIG. 18 with its bolt.

As can be seen from FIG. 19, when the housings are brought together the shackle is visible from only one side; this one side will be obscured by the staple or member being secured. Thus, there is only limited access for any person intent on cutting or sawing the shackle.

In an alternative embodiment (see for example the embodiment of FIG. 20), one or both of the lip 1074 and the portion of the supplementary holding means 1076 can be removed locally whereby to increase the freedom of access adjacent the shackle (e.g. for ease of use).

To secure the first and second housings together, the bolt 1020 is inserted through the bolt-carrying channel 1019 and into the bolt receiving-channel 1034, being retained therein by a catch 1025 behind step 1037. Catch 1025 is tapered and is spring biassed towards its projecting condition (as shown), so that the bolt 1020 can be inserted into the bolt-carrying channel 1019 without operation of the key. Once projecting behind the step 1037, however, the catch 1025 may only be retracted by operation of the key 1061.

In the embodiment shown, the bolt 1020 is circular, and so is rotatable in the bolt-carrying and bolt-receiving channels 1019 and 1034 respectively. In order to facilitate correct alignment of the catch 1025 with the step 1037, it will be understood that in a first alternative embodiment the bolt carries a lug which is slidable in a keyway of the bolt-carrying channel; in a second alternative embodiment the bolt itself is acircular.

It will be understood that in the embodiment shown, the two housings 1012,1014, and the bolt 1020, are separable from each other i.e. the padlock comprises three separate pieces. In an alternative embodiment, however, they are permanently or semi-permanently connected together. For example, the second housing may be slidable relative to the first housing, but with an abutment provided to limit the sliding separation sufficient only to permit the shackle to be placed around a staple or other member. The bolt can have a lip preventing its removal from the bolt-carrying channel.

Figure 20:
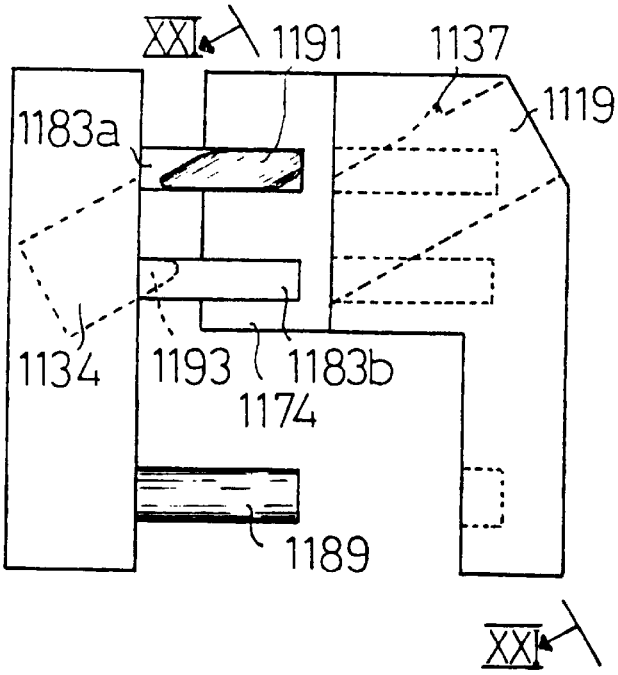
FIG. 20 is a view of a twelth embodiment of first and second housings.
Figure 21:
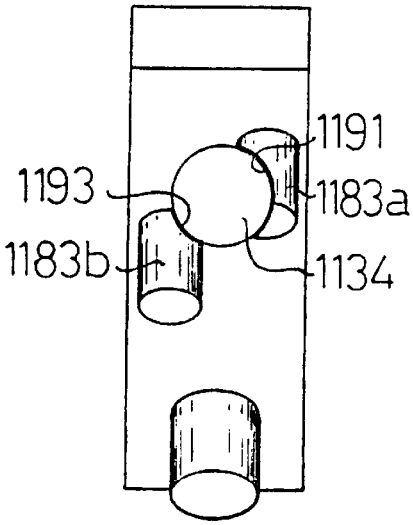
FIG. 21 is a view of the second housing of FIG. 19, along the line XXI—XXI.

Another embodiment of padlock is shown in FIGS. 20, 21. Whereas in the embodiment of FIGS. 18 and 19 the bolt 1020 cooperating with the bolt-carrying channel and the bolt-receiving channel provides the security against the forced separation of the housings, in the embodiment of FIGS. 20 and 21 the studs 1183*a,b* additionally contribute to this security. In this embodiment, the studs 1183*a,b* are placed sufficiently close to the bolt-carrying channel 1119 and bolt-receiving channel 1134 that the bolt, in its inserted condition, also passes partially through the body of the studs. Thus, the cut-away portions 1191 and 1193 of the studs partially embrace the bolt in its inserted condition, acting with the bolt 1120 to resist separation of the housings.

In this embodiment also, the lip 1174 is of reduced size, to allow easier access to the shackle 1189; however, it will be understood that another embodiment will have an encompassing lip equivalent to that of the FIG. 18 embodiment.

Also in the FIG. 20 embodiment, the step 1137 for retaining the bolt is located in the first housing 1112.

In another embodiment only one stud, with its respective cut-away portion, is provided. In yet another embodiment more than two studs, some or all of which have a respective cut-away portion, is provided.

Figure 22:
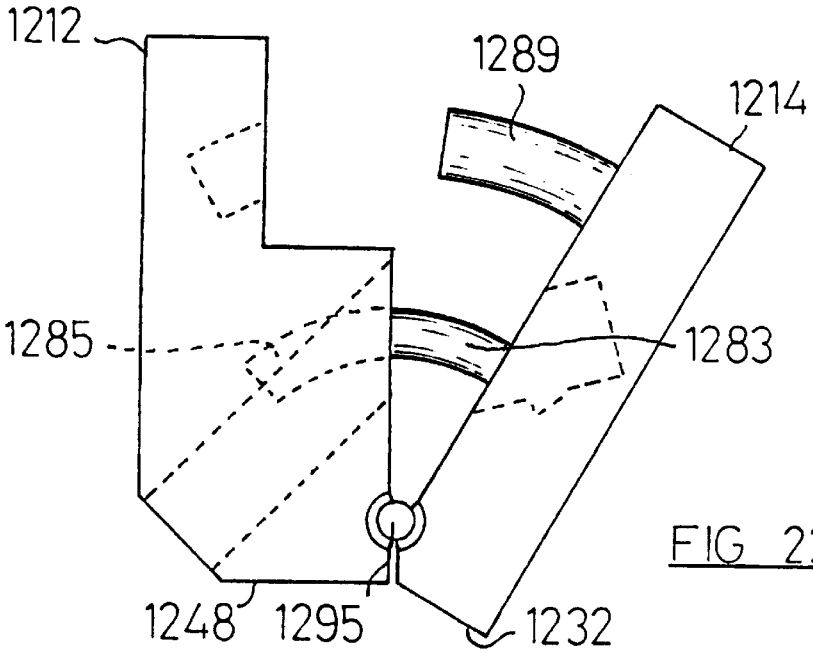
FIG. 22 is a view of a thirteenth embodiment of first and second housings, the housings being coupled together.

In the embodiment of FIG. 22, the first and second housings 1212,1214 are coupled together by a hinge 1095. In this embodiment, the stud(s) 1283, the respective holes 1285, and the shackle 1289, are curved; the curved holes being suitably formed by welding a section of curved tube into the first housing 1212. The hinge is located slightly inwardly of the end walls 1232,1248 of the housings, to increase the difficulty of obtaining access to the hinge, as may be desired by an intending thief. In another embodiment of the invention a protective cover piece may be provided to obscure the hinge.

In another embodiment, the shackle is closer to the hinge than the bolt carrying and bolt receiving channels.

In the embodiments of FIGS. 20, 21 and FIG. 22, the studs are mounted on the second housing and the holes are located in the first housing; in alternative embodiments the positioning of the studs and holes are reversed. Likewise, in a similar but alternative embodiment to that of FIGS. 18, 19, the studs are mounted on the second housing and the holes located in the first housing.

Figure 23:
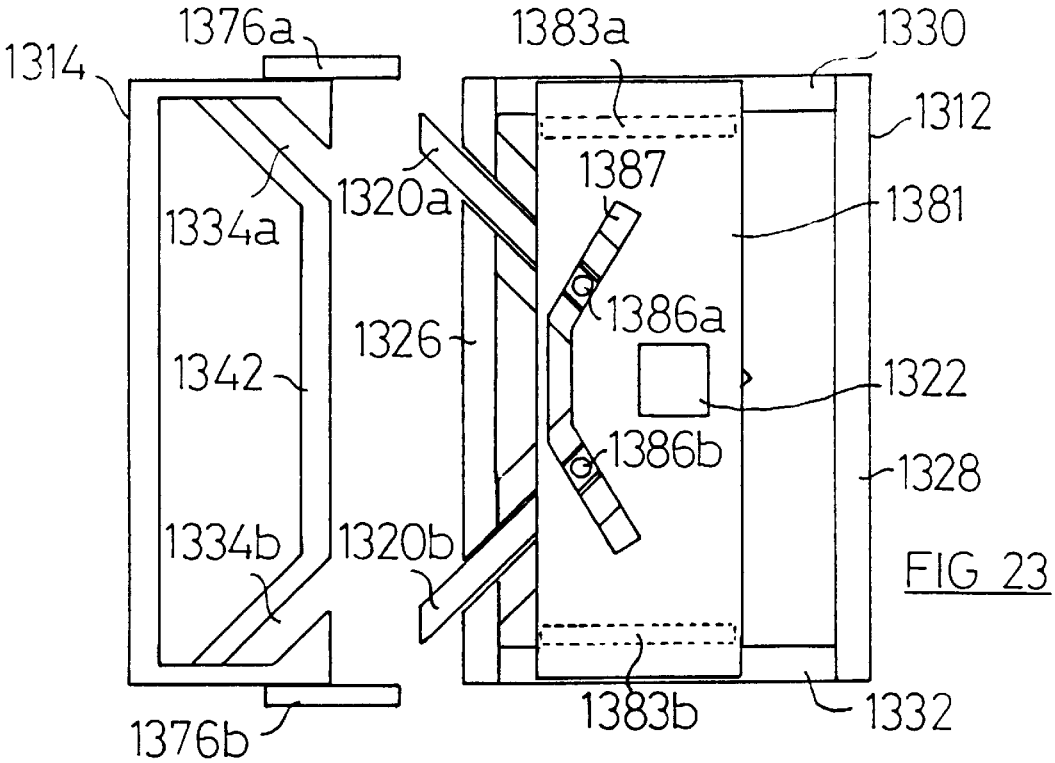
FIG. 23 is a front view of a fourteenth embodiment of first and second housings.

In the embodiment of FIG. 23, the first housing 1312 carries two bolts 1320*a*,1320*b*, which are guided at an angle to each other. The bolts 1320*a,b* are receivable in respective bolt carrying channels 1334*a*,1334*b* of the second housing 1314. Slidably mounted to the first housing 1312 is a slide plate 1381, which has a slot 1387. Each bolt 1320*a,b*, carries a respective peg 1386*a*,1386*b*; the pegs 1386*a,b* are located within the slot 1387, so that movement of the plate to the right and left as drawn effects simultaneous movement of the bolts 1320*a,b* into and out of the first housing 1312 respectively.

The slide plate 1381 carries a handle 1322, which is a square block projecting from the plate outwardly of the paper. In use, the handle will project through a slot in a front wall or face plate (not shown), closing the housing 1312.

The slide plate 1381 is guided within the first housing 1312 by a pair of projections 1383*a*,1383*b*, which slide against the end walls 1330 and 1332 of the housing respectively. The slide plate 1381 is slidable between a "bolt retracted" condition in which the plate engages the side wall 1328, and a "bolt extended" condition in which the plate engages the side wall 1326.

In the embodiment shown, the second housing 1314 carries supplementary holding means in the form of lip portions 1376*a*,1376*b*, which extend beyond the side wall 1342 of the second housing, and, in the closed condition of the housings, partially embrace respective end walls 1330 and 1332 of the first housing. It will be understood that another lip portion may be provided on the second housing 1314 to obscure the gap between the housings in their closed condition.

In an alternative embodiment, the lip portions 1376*a,b* are not present, and each bolt acts as the supplementary holding means for the other respective bolt. Thus, the wedging action of the invention may be effected by the two bolts 1320*a,b* moving in different angular directions, as well as between one or other bolt and the respective lip portion.

Figure 24:
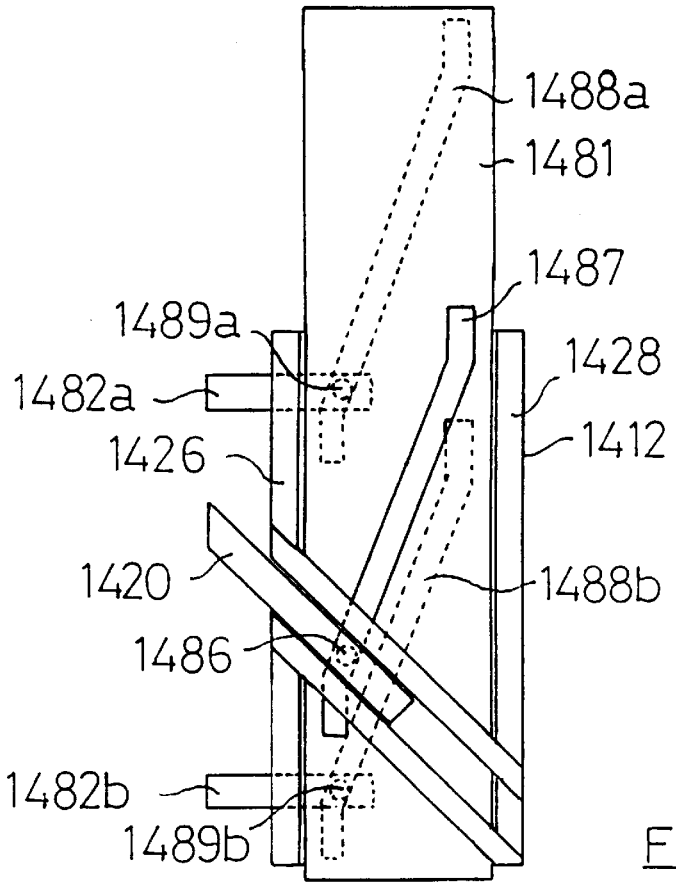
FIG. 24 is a front view of a fifteenth embodiment of first housing.

FIG. 24 shows a fifteenth embodiment of first housing. In this embodiment, a slide plate 1481 is slidably mounted between the side walls 1426 and 1428 of the housing 1412. Movement of the slide plate 1481 upwards and downwards (as drawn) causes respective extending and retracting movement of the bolt 1420 and arms 1482*a*,1482*b*; the arms 1482*a,b* providing the supplementary holding means in this embodiment. As drawn, the bolt 1420 is close to its fully extended condition, i.e. the slide plate 1481 is close to its upwards (as viewed) limit of movement.

The bolt 1420 is located to one side of the plate, the arms 1482*a,b*, are located to the other side of the plate. The sliding plate 1481 comprises two layers. In the front layer (i.e. the visible layer facing out of the paper as drawn), there is provided a generally angled slot 1487, which slot locates a peg 1486 carried by the bolt 1420. In the rear layer of the sliding plate 1481 there are two generally angled slots 1488*a*,1488*b*, which locate respective pegs 1489*a*,1489*b* carried by the arms 1482*a,b* respectively.

In the embodiment shown, the slots 1487,1488*a,b* are generally angled, but adjacent their ends they each have a portion substantially parallel with the direction of movement of the plate 1481. In other embodiments, the form of the slots may be varied, as desired, e.g. in one other embodiment, the slots are generally at a greater angle relative to the direction of movement of the plate, so that the plate requires less movement to effect the desired movement of the bolt and arms. In another embodiment the sliding plate is a single layer, and the slots pass through the plate; in such an embodiment, the positioning of the bolt and arms will be chosen so that the respective slots do not intersect.

The embodiment of FIG. 24 is particularly suited to use for a slidable glazed door, such as a patio door. In such a panel, the frame section within which a bolt housing must be located is narrow, so that the housing must also be narrow. It is thus desirable that the movement of the slide plate be substantially parallel with the side walls of the housing.

The embodiments of FIGS. 23 and 24 are shown without key-controlled release means. Such embodiments may be useful e.g. for external doors where the housings are inaccessible from outside the door or building, so that key control is not required. However, in an alternative embodiment similar to that of FIG. 23, key controlled release means could be fitted into the front wall of the first housing, to engage the block 1322. In an alternative embodiment similar to that of FIG. 24, the slide plate could have an extension carrying a rack, which rack is engaged by a key-controlled pinion (similar to that for the embodiment of FIG. 8), so that rotation of the key caused the required movement of the slide plate.

In all of the embodiments shown the surface beyond which the bolt tip can project is planar. However, in other embodiments the surface may be other than planar, i.e. part of the surface may be recessed, curved or otherwise angled relative to the remainder of the surface without departing from the scope of the invention. In use, the surface beyond which the bolt tip can project will generally be substantially parallel to the edge of the panel to which the housing is secured.

I claim:

1. A bolt assembly which includes (i) a first bolt housing, a bolt having a bolt tip, a first bolt guide carried by the first bolt housing, the bolt having a longitudinal axis and being mounted for longitudinal sliding movement in a direction constrained by and relative to the first bolt guide, the first bolt housing having a surface beyond which the bolt tip can project while said bolt is constrained by said first bolt guide, the first bolt guide being at an acute angle to said surface, (ii) a first bolt tip channel for receiving the first bolt tip alignable with the first bolt guide, the bolt tip being movable into and out of the first bolt tip channel only when said first bolt guide and first bolt tip channel are aligned, (iii) a second housing comprising the first bolt tip channel, (iv) supplementary holding means mounted to the first bolt housing for restraining movement of the first bolt guide relative to the first bolt tip channel parallel to said surface when the bolt tip is received in the first bolt tip channel, wherein said supplementary holding means is external to both the first bolt housing and the second housing when the assembly is in a closed condition and the supplemental holding means being movable relative to the first bolt housing, said first bolt housing being adapted for fitment to a panel.

2. An assembly according to claim 1 wherein the bolt has abutment means for halting the bolt, and retaining means for holding the bolt cooperable with the abutment means provided in one of the first bolt guide and first bolt tip channel.

3. An assembly according to claim 2 wherein at least one key controlled release for the bolt is mounted to one of the first and second housings.

4. An assembly according to claim 1 characterized in that the first and second housings are interconnected, the assembly forming a padlock.

5. An assembly according to claim 1 wherein the supplementary holding means comprise a tip of a second bolt in a second bolt tip channel, the first housing having second bolt guide for said second bolt, the second bolt guide being at an angle to the first guide.

6. An assembly according to claim 1 further including mounting means adapted to secure at least one of said first bolt housing and said second housing to a respective panel.

7. An assembly according to claim 1, said supplementary holding means being mounted on the first bolt housing at an acute angle to said first bolt guide, the supplementary holding means being one of a lip member and at least one projecting member.

8. An assembly according to claim 1 further including resilient biasing means located to urge the bolt tip towards a position in which the said bolt tip projects outwardly from said surface of the first bolt housing.

9. An assembly according to claim 1 wherein the second housing is adapted for fitment to a respective panel.

10. An assembly according to claim 1, wherein said supplementary holding means engages the second housing only when the bolt is in an extended condition.

11. A bolt assembly comprising:

(i) a bolt housing, a bolt having a bolt tip, a bolt guide carried by the housing, the bolt having a longitudinal axis and being mounted for longitudinal sliding movement in a direction constrained by and relative to the bolt guide, the bolt housing having a surface beyond which the bolt tip can project while said bolt is constrained by said bolt guide, the bolt guide being at an acute angle to said surface, (ii) a bolt tip channel for receiving the bolt tip alignable with the bolt guide, the bolt tip being movable into and out of the bolt tip channel only when said bolt guide and bolt tip channel are aligned, (iii) supplementary holding means restraining movement of the bolt guide relative to the bolt tip channel when the bolt tip is received in the bolt tip channel, wherein the supplementary holding means comprises a holding member carried by the bolt housing, the holding member being movable relative to the housing and the holding member having a holding surface at an angle to the longitudinal axis of the bolt.

12. A bolt assembly according to claim 11, wherein the holding member has a longitudinal axis and is mounted for longitudinal sliding movement relative to the bolt housing, the longitudinal axis of the holding member being at an angle to the longitudinal axis of the bolt.

13. An assembly according to claim 11, wherein the bolt housing is a first housing, while the bolt assembly further comprises a second housing, the second housing comprising the bolt tip channel, the second housing also having a restraining surface cooperable with the holding surface of the holding member.

14. An assembly according to claim 11, wherein the bolt is a first bolt and the holding member is a second bolt.

* * * * *

UNITED STATES PATENT AND TRADEMARK OFFICE
CERTIFICATE OF CORRECTION

PATENT NO : 5,836,625

DATED : November 17, 1998

INVENTOR(S) : Anthony Wilfred Kibble

It is certified that error appears in the above-identified patent and that said Letters Patent is hereby corrected as shown below:

Column 9, line 26: "in, the locked" should be --in the locked--

Signed and Sealed this

Thirtieth Day of March, 1999

*Attest:*

Q. TODD DICKINSON

*Attesting Officer*

*Acting Commissioner of Patents and Trademarks*